US007337719B2

(12) United States Patent
Sculler

(10) Patent No.: US 7,337,719 B2
(45) Date of Patent: Mar. 4, 2008

(54) HAND STAMP MARKING STRUCTURE FOR PRINTING MULTIPLE INKS

(75) Inventor: Steven J. Sculler, Morganville, NJ (US)

(73) Assignee: M&R Marking Systems, Inc., Piscataway, NJ (US)

( * ) Notice: Subject to any disclaimer, the term of this patent is extended or adjusted under 35 U.S.C. 154(b) by 132 days.

(21) Appl. No.: 10/939,072

(22) Filed: Sep. 10, 2004

(65) Prior Publication Data

US 2005/0061175 A1 Mar. 24, 2005

Related U.S. Application Data

(60) Provisional application No. 60/503,864, filed on Sep. 19, 2003.

(51) Int. Cl.
*B41F 31/00* (2006.01)
*B41K 1/38* (2006.01)

(52) U.S. Cl. ..... 101/327; 101/125; 101/333; 101/405

(58) Field of Classification Search ..... 101/405, 101/406, 327, 333, 334, 125, 128.21
See application file for complete search history.

(56) References Cited

U.S. PATENT DOCUMENTS 3,227,079 A 1/1966 Muskin
3,442,209 A 5/1969 Funahashi
3,446,143 A 5/1969 Williamson
3,478,682 A 11/1969 Funahashi
3,988,897 A 11/1976 Strub
3,988,987 A 11/1976 Ikura et al.
4,625,640 A 12/1986 Bunger
5,471,930 A 12/1995 Wood
5,505,130 A 4/1996 Winston
5,531,829 A 7/1996 Yasoshima
5,577,444 A * 11/1996 Toyama ..... 101/379
5,586,500 A 12/1996 Takami et al.
5,601,644 A 2/1997 Yasoshima
5,636,569 A 6/1997 Winston
5,653,804 A 8/1997 Yasoshima
5,655,451 A 8/1997 Wasylczuk et al.
5,865,892 A 2/1999 Yasoshima
5,870,953 A 2/1999 Winston
6,000,335 A 12/1999 Imamaki et al.
6,047,639 A 4/2000 Shih
6,119,596 A 9/2000 Fletcher et al.
6,239,806 B1 5/2001 Nichiumi et al.

(Continued)

FOREIGN PATENT DOCUMENTS

JP 60244585 A * 12/1985

*Primary Examiner*—Daniel J. Colilla
*Assistant Examiner*—Kevin D. Williams
(74) *Attorney, Agent, or Firm*—Lerner, David, Littenberg, Krumholz & Mentlik, LLP

(57) ABSTRACT

A hand stamp includes a unitary marking structure having a plurality of ink-storing regions. The unitary marking structure has front and rear surfaces and substantially porous portions between the front and rear surfaces. The unitary marking structure has a first region adapted to store a first ink and a second region adapted to store a second ink. The first and second inks may be different, such as different colors. A substantially non-porous barrier is provided between the first and second regions of the marking structure to prevent the inks from migrating between the first and second regions.

55 Claims, 12 Drawing Sheets

U.S. PATENT DOCUMENTS 6,289,806 B2 9/2001 Hirano
6,499,398 B2 * 12/2002 MacNeil ..... 101/327
6,634,288 B1 * 10/2003 Imamaki et al. ..... 101/125
6,827,014 B1 * 12/2004 Marshall et al. ..... 101/327
7,273,009 B2 * 9/2007 Yip ..... 101/327

* cited by examiner

HAND STAMP MARKING STRUCTURE FOR PRINTING MULTIPLE INKS

CROSS REFERENCE TO RELATED APPLICATIONS

This application claims the benefit of the filing date of and U.S. Provisional Patent Application Ser. No. 60/503,864, filed Sep. 19, 2003, and is related to U.S. patent application Ser. No. 10/627,911 filed Jul. 25, 2003, the disclosures of which are hereby incorporated herein by reference.

BACKGROUND OF THE INVENTION

The present invention relates to hand stamps. A marking structure is an article having a pattern formed thereon for use in printing an ink onto a printable surface. A marking structure is sometimes referred to as a "stamp die" or a "stamp text plate".

Microporous marking structures for use with hand stamps are typically made of a polymeric material, or other open cell compositions, such as specially formulated foam, and resin, such as thermoplastic resin, which combine to form a slab-like structure including a large quantity of microscopic pores. The microporous structure may be impregnated with ink or other suitable marking fluid, which fill many of the microscopic pores.

Hand stamps having microporous marking structures are commercially known as pre-inked hand stamps as they can be used to create numerous impressions without requiring a user to introduce additional ink into the marking structure. This is possible due to the microscopic size of the pores, which allow the ink initially retained therein to escape at a controlled rate.

One high quality, pre-inked hand stamp is manufactured and sold under the trademark ROYAL MARK by M&R Marking Systems Inc. of Piscataway, N.J. These pre-inked hand stamps include marking structures made using a gel comprising a mixture of thermoplastic resin and ink, which is commonly referred to as a pre-mix.

There are a variety of methods for manufacturing microporous marking structures. In one method, the pre-mix, which includes a desired quantity of ink, is poured into a mold. The mold is then heated in a vulcanizer at a predetermined pressure and temperature for a selected period of time. When the pressure, temperature and time parameters have been satisfied, the marking structure is formed into a microporous slab. The marking structure is then removed from the mold and any excess ink in the structure is removed during a stabilizing process. The marking structure has a resilient microporous network that contains ink, which is released through protruding indicia of a molding when pressed against a surface to be marked.

Another well known method of manufacturing microporous marking structures includes initially forming a microporous structure that does not contain ink. Such microporous marking structures may be manufactured by sintering, salt-leaching or other methods. This type of microporous marking structure is impregnated with ink during a separate procedure which may involve immersing the microporous marking structure in an ink pool, subjecting the microporous marking structure and ink to a vacuum environment or other known methods. With this type of microporous marking structure, it is generally necessary to stabilize the structure, i.e. remove excess ink therefrom, prior to assembly of the marking structure on a hand stamp mount.

Another type of pre-inked stamp uses a microporous foam upon which an image is flash printed. One flash exposure system for manufacturing pre-inked hand stamps is described at M&R Marking System Inc.'s Website at www-.mrmarking.com and is provided under the trademark ULTI-MARK. In general, the ULTIMARK system comprises a computer controlled flash irradiation device which exposes select areas of foam text plates (i.e. marking structures that have been formulated to be used in pre-inked hand stamps) to a high energy light source for a period of time. A protective film is used to shield certain areas of the microporous foam so that the shielded areas are not exposed to the light source. The brief exposure to light causes the exposed surfaces of the text plate to melt creating substantially non-porous areas at the exterior surfaces of the microporous foam. The unexposed areas remain porous so that the microporous foam can be subsequently used as a marking structure in hand stamps.

In one particular embodiment of the ULTIMARK system, the flash-exposed pre-inked stamps are made by printing or imaging a positive or negative image on a transparent paper or plastic, and then placing that image on a transparent body of typically glass or plastic in between a light source and the microporous foam to be exposed. A clear protective sheet may be placed over the flash exposable microporous material and on top of a transparent indicia medium. A process for preparing a microporous material for flash exposure is disclosed in commonly assigned U.S. patent application Ser. No. 10/439,469, the disclosure of which is incorporated herein by reference.

There have been a number of efforts directed to producing ink stamps capable of printing in two or more colors. For example, U.S. Pat. No. 6,239,806 to Hirano describes a stamp having "stamping material" (i.e. the stamping part) which has a continuous porous structure for holding and releasing ink through patterns on the stamping face thereof to imprint an object. The continuous porous stamping material is fed from the back side by a separate occlusion body (i.e., an ink reservoir) having two or more sections for holding inks of different colors. While the reservoir has a physical barrier and/or an isolation part (e.g., a space) for keeping the inks separate, the continuous porous stamping material has neither barrier nor physical separation between portions filled with different inks. Hirano further describes the inks themselves as "becom[ing] a physical barrier" when the stamping material is simultaneously filled with ink, in that "each ink does not excessively penetrate out of each desired area." (col. 10, lns. 8-10) (Emphasis added) It is clear from the above description that Hirano neither teaches nor suggests any barrier in the stamping material itself for preventing the different inks from migrating between respective portions and mingling with each other.

U.S. Pat. No. 6,047,639 to Shih discloses a stamping set including at least one partition strip that separates an enclosed space into at least two rooms for separating ink of two different colors. Although the '639 patent also addresses the issue of preventing color mingling, it also requires the use of an additional component, i.e. a partition strip.

U.S. Pat. No. 5,601,644 discloses a multi-color ink stamp pad, whereby a thin, aqueous-impermeable film is disposed between the pads for preventing color mingling. Thus, the '644 patent also requires an additional part to prevent mixing of the different colored inks.

There have also been a number of efforts direct to simplifying assembly of hand stamps. For example, U.S. Pat. No. 3,988,987 to Ikura discloses a stamp frame having a vertical interlocking projection on one of its side surfaces, a vertical interlocking groove on the opposite side surface, and a holding member removably mountable over the stamp elements to prevent displacement of the stamp elements relative to one another. Although Ikura applies to ensuring proper assembly of a stamp device, it teaches a registration concept applied to a stamp frame rather than the stamp pad itself. As such, there is nothing in the disclosure indicating a registration concept on the adjacent portions of the marking structure to facilitate the assembly of marking structures on a hand stamp mount.

SUMMARY OF THE INVENTION

In certain preferred embodiments of the present invention, a hand stamp includes a unitary marking structure having a plurality of ink-storing regions. The unitary marking structure has front and rear surfaces and substantially porous portions between the front and rear surfaces. The unitary marking structure has a first region adapted to store a first ink, and a second region adapted to store a second ink. The first and second inks preferably have different colors. A substantially non-porous barrier is provided between the first and second regions to prevent the inks from migrating between the first and second regions. The marking structure may be made of microporous foam. In other preferred embodiments, the marking structure may be made of a mixture of a thermoplastic resin and ink.

A first ink may be disposed in the first region of the marking structure and a second ink may be disposed in the second region of the marking structure. The first ink desirably has a first color and the second ink desirably has a second color that is different than the first color.

The unitary porous marking structure preferably includes a foam member, whereby the barrier is integrally formed in the marking structure by heating selected locations of the foam member. The selected locations may be heated by exposing the marking structure to light, such as light produced by a laser. The marking structure may also be heated by contacting the marking structure with a thermally conductive member, such as by pressing the thermally conductive member against the foam member at the selected locations to form the barrier.

The front surface of the marking structure desirably includes porous areas adapted to print the inks and non-porous areas adapted to block release of the inks, and first and second print patterns adapted to print the first and second inks, respectively, being defined by the porous areas disposed in the first and second regions, respectively. The non-porous areas may be defined in the front surface by exposure of the marking structure to light. The barrier is desirably formed simultaneously by the exposure to light.

The first and second ink reservoirs may be secured to the hand stamp, with the ink reservoirs being adapted to supply ink to the first and second regions. The hand stamp may also include a handle, with the marking structure being mounted at an opposite end of the hand stamp from the handle.

In certain preferred embodiments, the hand stamp includes a case, and a platen secured for selective movement within the case, whereby the marking structure is retained with the platen for movement therewith between a non-marking position where the marking structure is remote from a surface to be marked and a marking position where the marking structure is pressed into contact with the surface to be marked. The hand stamp also desirably includes first and second ink reservoirs secured to the hand stamp and adapted to apply the first and second inks to the first and second regions, respectively. The first and second ink reservoirs preferably comprise first and second porous pads, respectively, the porous pads being disposed between the marking structure and the platen. A retaining member may be mountable to the platen in a plurality of positions, the retaining member being adapted to secure the marking structure and the ink reservoirs to the platen in one of the plurality of positions.

The first and second porous pads may include open cell foam. The stamp may also include a blocking member disposed between the first and second porous pads, whereby the blocking member desirably prevents migration of ink between the first and second porous pads. The blocking member may include closed cell foam.

The plurality of positions of the retaining member may include an infinite number of positions between a lowermost position and an uppermost position, whereby the ink reservoirs and the marking structure can be secured to the platen.

The platen preferably includes a substantially planar bottom surface, a top surface and a perimeter, with the retaining member including a frame defining an interior opening. The stamp also desirably includes at least one clip constructed and arranged to secure the retaining member to the platen by friction, the at least one clip extending in a direction substantially perpendicular to the bottom surface of the platen. The at least one clip desirably forms part of and is integral with the retaining member.

In certain preferred embodiments, the frame comprises a ledge and a sidewall integral with and substantially perpendicular to the ledge, the ledge extending into the interior opening and lying in a plane substantially parallel to the bottom surface of the platen. The marking surface of the stamp die preferably has a perimeter and is arranged flat against and adjacent to the ledge.

The platen preferably comprises a platen wall that defines the perimeter of the platen, the platen wall extending in a direction substantially perpendicular to the bottom surface of the platen, with the marking structure and the porous pads being enclosed by the platen wall. The platen wall desirably has at least one groove having a width adopted for receiving the fingers of the spring, the groove extending in a direction substantially perpendicular to the bottom surface of the platen. The fingers are preferably engaged in the groove with the fingers being flexed toward each other to exert pressure in a direction opposite to the direction of their flexing, whereby the retaining member is mounted on the platen in a friction-fit arrangement. The hand stamp may also include a spring for biasing the platen into the non-marking position, the platen being adopted for reciprocal movement within the case. The hand stamp may also preferably include a shaft arranged within the case and being connected between the platen and the handle.

In certain preferred embodiments, the hand stamp includes at least one clip having a pair of flexible and resilient fingers. The at least one clip desirably extends upwardly from and is integral with the sidewall of the frame of the retaining member. The at least one clip preferably includes a pair of flexible and resilient fingers having a form of a letter "V", with the fingers being capable of moving toward each other such that the broad part becomes more narrow. The platen wall preferably has at least one groove having a width adopted for receiving the flexible and resilient fingers, the at least one groove extending in a direction substantially perpendicular to the bottom surface of the platen. The fingers are preferably engaged in the at least one groove, whereby the fingers are flexed toward each other for exerting pressure in a direction opposite to the direction of their flexing so that the retaining member is mounted on the platen in a friction-fit arrangement. In certain preferred embodiments, the retaining member may have four clips.

In certain preferred embodiments, the platen, the porous pads and the retaining member are substantially rectangular. The retaining member may be constructed of a resilient and flexible material, such as a plastic material.

In certain preferred embodiments, the hand stamp may include a pair of openings through the platen for supplying the first and the second inks to the marking structure. The hand stamp may also include first and second ink reservoirs disposed in contact with the rear surface of the marking structure, whereby the first and second openings are disposed for supplying the first and second inks to the first and second ink reservoirs, respectively.

In another preferred embodiment of the present invention, a marking structure for a hand stamp includes a unitary member having front and rear surfaces and substantially porous portions between the front and rear surfaces. The unitary member desirably includes a first region adapted to store a first ink, a second region adapted to store a second ink, and a substantially non-porous barrier arranged between the first and second regions to prevent the inks from migrating between the first and second regions. The first ink preferably has a first color and the second ink preferably has a second color that is different than the first color.

The unitary member may be a microporous foam or a mixture of thermoplastic resin and ink. In certain preferred embodiments, the unitary member may include a foam member, with the barrier being integrally formed in the unitary member by heating selected locations of the foam member. The selected locations may be heated by exposing the foam member to light, such as light produced by a laser.

The front surface of the marking structure desirably includes porous areas adapted to print the inks and non-porous areas adapted to block release of the inks. The front surface also desirably includes first and second print patterns that are adapted to print the first and second inks. The porous areas of the marking structure desirably define the first and second print patterns. The non-porous areas are preferably defined in the front surface by exposure of the unitary member to light.

The barrier may be formed by exposure to light. The barrier may also be formed by pressing the thermally conductive member against the foam member at the selected locations.

In another preferred embodiment of the present invention, a method of making a multi-ink marking structure for a hand stamp includes providing a unitary foam member having a front surface, a rear surface and peripheral edges extending between the front surface and the rear surface. The method desirably includes sealing selected locations of the foam member to form a barrier extending at least substantially between the front surface and the rear surface, and dividing the foam member into first and second regions adapted to store first and second inks, respectively, while remaining permanently connected to the first and second regions of the foam member. The barrier is desirably adapted to prevent migration of inks between the first and the second regions. The method also desirably includes defining print patterns at the front surface.

The sealing step is desirably performed by heating, such as by using light or laser radiation. The heating step may be performed in a fixture that is also used for defining the print patterns. The print patterns are preferably defined by exposure to a light varying in at least one of energy, intensity and duration from the light used to perform the heating step. The heating step may be performed while blocking the light from reaching predetermined areas of the front surface. The predetermined areas may comprise areas on which the print patterns are defined. The heating may also be performed by contacting the foam member with a thermally conductive member, such as a thermally conductive member pressed to the selected locations while heating the selected locations. The thermally conductive member may include a wire, wherein the heating further includes moving the wire across a surface of the foam member. The wire may be moved according to a program executed by a processor. The thermally conductive member may also include a patterned plate and the heating step may include simultaneously contacting all of the selected locations with the patterned plate.

In yet another preferred embodiment of the present invention, a method of making a multi-ink marking structure for a hand stamp includes mixing a first batch including a foam precursor liquid and a first ink, mixing a second batch including the foam precursor liquid and a second ink, and filling first and second portions of a mold with the first and second batches, respectively, the mold having a thin portion dividing the first portion from the second portion. The method also desirably includes vulcanizing the first and second batches to form first and second ink-storing regions in the first and second portions and a barrier in the thin portion, the barrier preventing ink from migrating between the first and second ink-storing regions, the barrier remaining permanently connected to the first and second ink-storing regions. A third batch including the foam precursor liquid may be provided to the thin portion, the third batch being preferably prepared without a marking fluid. The method may also include locally providing heat to the thin portion during the vulcanizing step.

In still another preferred embodiment of the present invention, a method of making a multi-ink marking structure includes sealing a first porous foam member, a second porous foam member and a substantially nonporous member together in a fixture to form a unitary member. The method may include flash-printing patterns onto portions of the unitary member corresponding to the first and second porous foam members to form first and second ink-storing regions of the unitary member, the first and second regions being separated by a barrier including the substantially nonporous member.

These and other preferred embodiments of the present invention will be described in more detail below.

DETAILED DESCRIPTION

Figure 1:
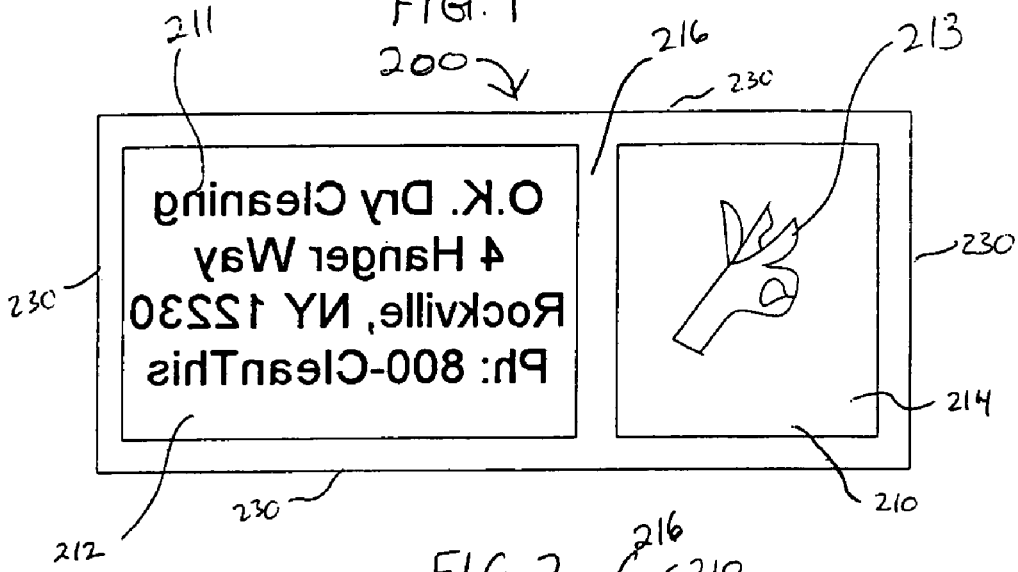
FIG. 1 is a plan view illustrating a front surface of a marking structure according to an embodiment of the invention.
Figure 2:
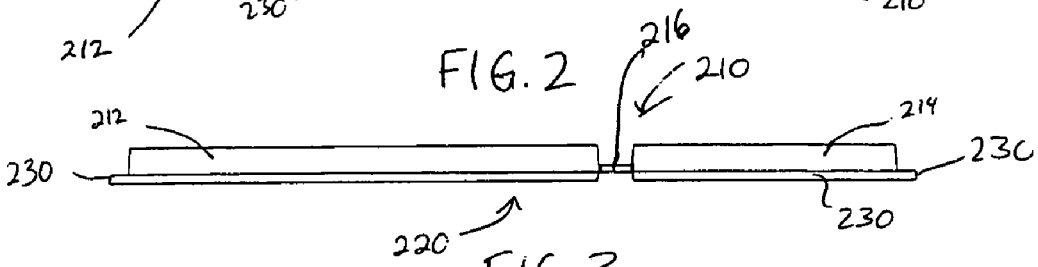
FIG. 2 is a side view illustrating a marking structure according to the embodiment of the invention shown in FIG. 1.
Figure 3:
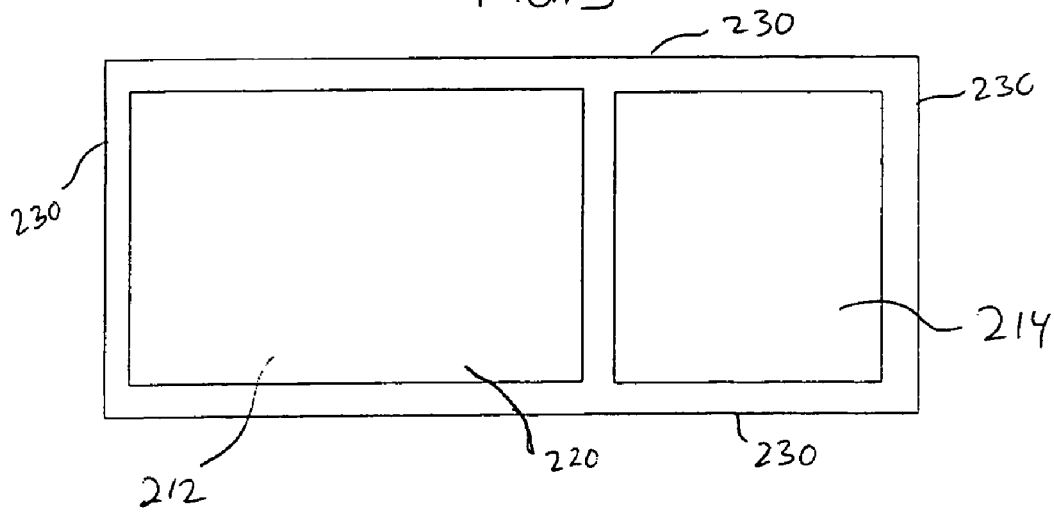
FIG. 3 is a view illustrating a rear surface of a marking structure according to the embodiment of the invention shown in FIGS. 1 and 2.

FIGS. 1, 2 and 3 illustrate a marking structure 200 according to an embodiment of the present invention. FIG. 1 is a front plan view illustrating a front surface of the marking structure 200. FIG. 2 is a side view illustrating the marking structure. FIG. 3 is a rear plan view illustrating a rear surface of the marking structure 200. The marking structure 200 is capable of being mounted to a hand stamp, as will be described below. When mounted to the hand stamp, the marking structure can be pressed to a surface of an article for imprinting text, a design, or both thereon.

As further illustrated in FIGS. 1, 2 and 3, the marking structure has a porous body adapted to store and release a plurality of inks according to a pattern defined by porous and non-porous locations in a front surface 210 thereof. Porous locations are adapted to release ink when the marking structure is pressed to an article. Non-porous locations are sealed to prevent the escape of ink therefrom. In an embodiment of the invention, the marking structure 200 is provided together with one or more inks as a pre-inked structure. The pre-inked structure can be achieved by fabricating the marking structure 200 and thereafter supplying ink to one or more ink-storing regions thereof. Alternatively, a pre-inked structure can be achieved by providing a pre-mix containing an ink to a mold, and then heating the mold to form a microporous slab containing the desired ink. The process for forming a pre-inked structure having a plurality of inks will be further described below.

The front surface 210 includes patterns 211, 213 for printing text, a design or both upon an article. As viewed from above the front surface 210, the patterns 211, 213 appear reversed such that the text and design as printed appear correctly. In an embodiment, the text and design to be printed can be defined by the porous locations in the front surface, while non pattern-forming locations are defined by non-porous locations. Alternatively, the text or design to be printed can be defined by non-porous locations in the front surface, while the porous locations define areas between or exterior to the text or design. The porous locations can be either flush with or preferably raised relative to the non-porous locations of the marking structure.

In another embodiment, the patterns can be defined by locations having raised height relative to the front surface alone, where all locations of the front surface remain porous or have substantially the same or similar porosity.

The marking structure 200 also has a rear surface 220 opposite the front surface and peripheral edges 230 extending between the front surface and the rear surface. In a particular embodiment, the marking structure 200 has four edges. In other embodiments, the marking structure can have less than four or more than four edges. The rear surface of the marking structure 200 can be porous, in order to accept the supply and/or resupply of inks thereto. Alternatively, the rear surface of the marking structure 200 can be sealed, as may be advantageous for a variety of reasons. For example, when the marking structure is provided as a pre-inked element containing desirable type(s) and quantit(ies) of ink, the rear surface can be sealed to provide a readily usable package which can be conveniently shipped, used and discarded when spent.

The marking structure 200 is particularly adapted to printing with a plurality of inks. The marking structure 200 includes first and second ink-storing and releasing regions 212 and 214, respectively, capable of storing and printing two different inks, for example, two different colored inks. For example, first region 212 may store a black color ink, while second region 214 may store a red color ink. Alternatively, the first and second regions 212 and 214 may store the same color ink. In yet another alternative, the first and second regions 212, 214 can store different types of fluids. For example, a first region 212 can store an ink capable of defining lined and fine-lined features, while a second region 214 can store a dye or other color selected to more generally cover or permeate an area.

The marking structure 200 has a unitary structure wherein the first and second ink-storing regions 212 and 214 are permanently connected by a physical barrier 216. The permanent connection of the physical barrier is a non-removable connection, such that the first and second regions normally remain joined and aligned at the mutual barrier for the life of the marking structure 200. The physical barrier extends at least substantially between the front surface 210 and the rear surface 220 of the marking structure. As shown in FIGS. 1-3, the physical barrier completely separates the first ink-storing region 212 from the second ink-storing region 214, preventing the migration of ink between the two regions.

The physical barrier is desirably formed integrally to the marking structure from the same material of which the first and second regions are formed. The process for forming the physical barrier will be described further below when the fabrication of the marking structure is described.

As also shown in FIGS. 1-3, the edges 230 of the marking structure are recessed relative to the ink-storing regions 212, 214. The recessed edges 230 can facilitate positive retention of the marking structure during fabrication for alignment reasons, and/or mounting of the marking structure 200 to the hand stamp (not shown). The recessed edges 230 can be formed generally in the same plane as the rear surface 220 of the first and second regions 212, 214 of the marking structure 200. Alternatively, the recessed edges can be formed generally in the same plane as the physical barrier 216.

Figure 4:
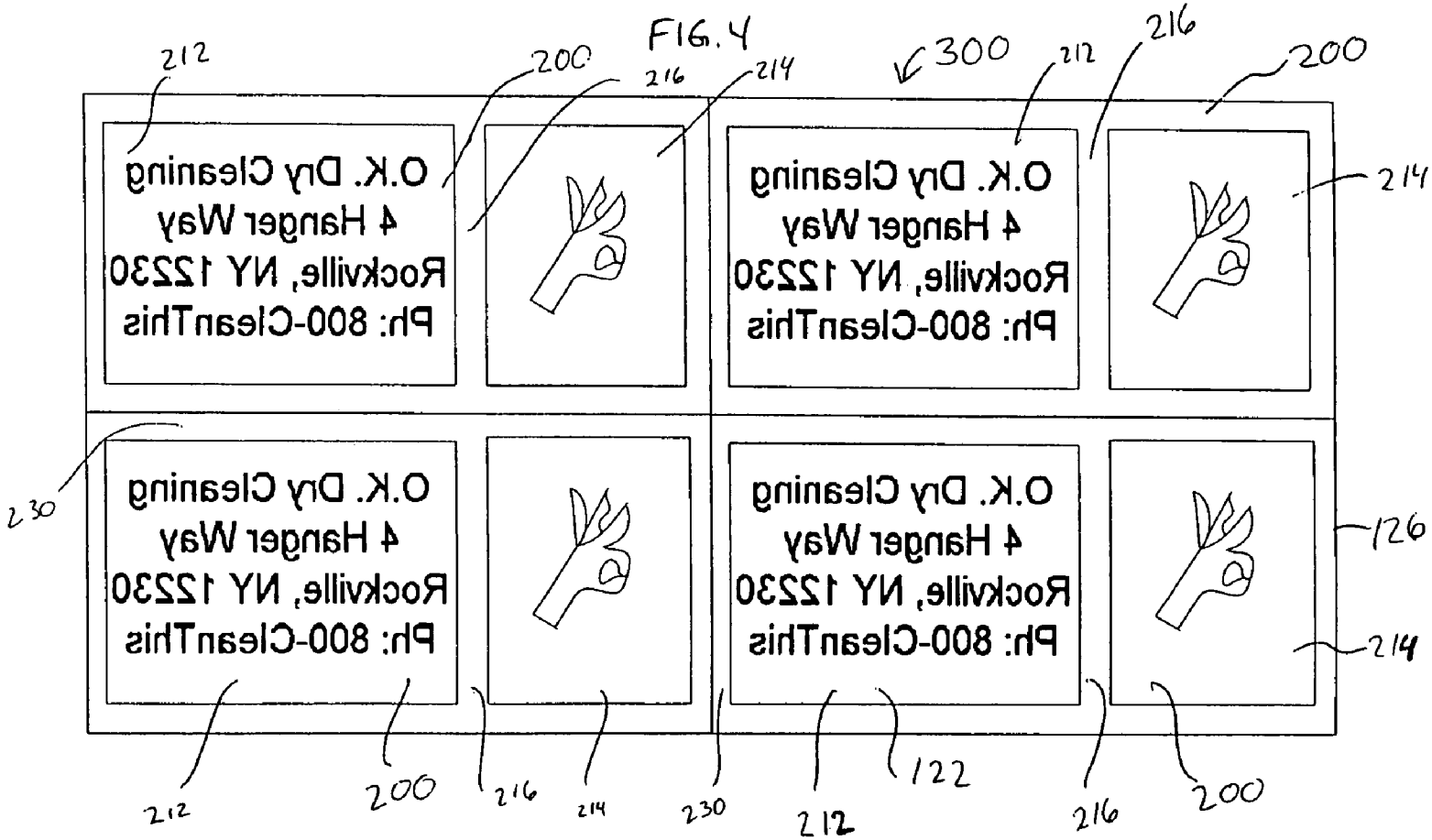
FIG. 4 is a plan view illustrating a front surface of a foam sheet on which marking structures according to the embodiment of the invention shown in FIGS. 1-3 are formed.

FIG. 4 illustrates a sheet on which a plurality of marking structures are formed. In a particular embodiment, four marking structures are provided per sheet. However, more or fewer marking structures can be formed on a particular sheet according to the sizes and numbers of the marking structures on the sheet, the size of the sheet and the capabilities of the fabrication equipment. After the marking structures 200 are formed, they are severed from one another. Alternatively, the marking structures 200 can be formed from smaller sheets sized to form individual marking structures, the smaller sheets being held together in a frame during fabrication.

The process of fabricating marking structures according to the present invention will now be further described, with additional reference to FIGS. 5A-7.

Figure 5A:
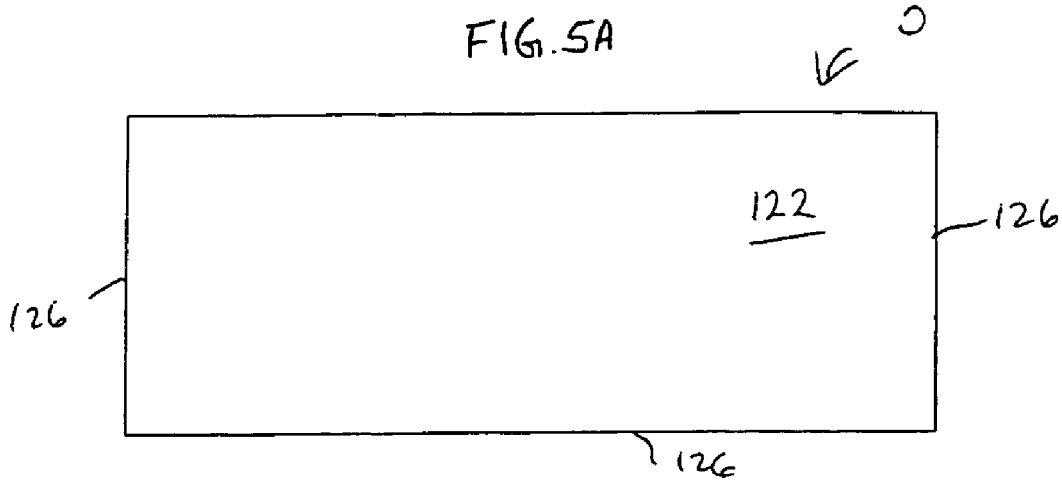
FIGS. 5A and 5B illustrate a foam sheet from which marking structures are formed according to embodiments of the invention.
Figure 5B:
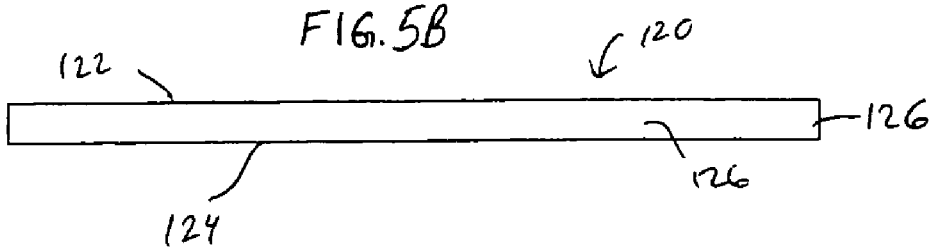

FIGS. 5A and 5B show a microporous foam sheet 120 having a top surface 122, a bottom surface 124 remote from the top surface 122, and one or more peripheral edges 126 extending between top surface 122 and bottom surface 124. In the particular microporous foam sheet 120 shown in FIG. 5A, the sheet has four edges 126 extending between top surface 122 and bottom surface 124. In other preferred embodiments, the sheet may have less than four or more than four edges.

Referring again to FIG. 4, a process may be used, such as that disclosed in commonly assigned U.S. patent application Ser. No. 10/439,469, to form marking structures that may be loaded with ink for creating pre-inked hand stamps. Microporous sheets can be made of a polymeric material or other open cell composition, such as specially formulated foam. Alternatively, a resin can be used, such as thermoplastic resin, which forms a slab-like structure including a large quantity of microscopic pores. In certain preferred embodiments, the microporous foam sheet of FIGS. 5A-B is exposed to a flash irradiation device whereby energy from a light source exposes certain areas of the foam to the light for melting the surface of the foam so as to form a non-porous area at the exterior surface of the foam. The unexposed areas of the foam remain porous so that the foam sheet can be subsequently used as marking structures in hand stamps for creating imprints on surfaces such as paper, envelopes and containers.

Referring again to FIG. 4, images are flash-printed on the front surface 122 of the printed foam sheet 300 such that the front surface 122 becomes substantially non-porous while the bottom, untreated surface (not shown) remains substantially porous.

Peripheral edges 126 are also desirably made substantially non-porous at this time, as well as peripheral edges 230 of each marking structure 200 and physical barriers 216 which divide each marking structure into first and second ink-storing regions.

A number of methods are available for creating physical barriers 216 in each marking structure. In a particular embodiment, physical barriers 216 are transformed from areas of the microporous foam sheet 120 by heating the areas to a sufficient temperature to melt the foam to a thickness at least substantially extending between the front surface 122 and the rear surface 124 of the foam sheet. The areas are desirably heated while applying pressure thereto to compress the areas into a denser, more compact mass. Pressure may be applied only from the top surface 122 or alternatively, from both top and bottom surface 122, 124 to form physical barriers 216 which lie between the rear surface 220 and front surface 210 of the marking structure 200.

In another embodiment, the areas can be locally heated to a sufficient temperature to densify the porous foam sheet material to form the barriers. In such case, the porous material is transformed locally to having much lowered porosity, such that the rate of fluid transfer through the barrier is much lower than through ink-storing regions of the marking structure.

In another embodiment, the physical barriers 216 are formed by exposure to light on the same fixture used to perform flash-printing as described above. As an example, a separate exposure can be used to form the physical barriers from that used to form images on the front surfaces 210 of the marking structures 200. During such exposure, a radiation-blocking cover sheet can be placed in the exposure fixture which covers all but the areas of the foam sheet 120 in which the barriers are to be formed. An exposure to radiation can then be made to the foam sheet of sufficient energy and duration to form the physical barriers without damaging the front, marking surfaces 210 or other parts of the marking structures 200.

Alternatively, a focused laser beam can be scanned across areas of the foam sheet 120 to locally heat the areas to a sufficient temperature to densify the areas to form the physical barriers. In such case, the areas can be either melted or at least heated to sufficient temperature to cause the porosity to be greatly decreased, such that the rate of fluid transfer is much lower through the physical barrier than through the ink-storing regions of the marking structures.

In an embodiment, the areas can be heated by contact with a thermally conductive member applying little or no appreciable pressure to foam sheet 120. In such case, melting is a dominant mechanism transforming the areas into the physical barrier. As a result of the heating and/or pressure, the areas form a physical barrier which does not permit ink (or other marking fluid desirably stored therein) to migrate between first and second ink-storing regions 212 and 214.

Such thermally conductive member can take the form of a metal wire or other thermal conductor capable of being moved across the top surface 122 of the foam sheet according to a processor-controlled pattern to form physical barriers at selectable locations, as selected and controlled by a program executed on a processor. In such case, the physical barrier can have a free-form contour, limited only by the resolution of the processor-controlled movement of the wire across the foam sheet. Such free-form shape can be highly advantageous if an image to be printed by the marking structure has different colored parts which do not lie along a straight line.

In yet another embodiment, the foam sheet is contacted by a thermally conductive member simultaneously in all areas where physical barriers are to be formed. In such case, the thermally conductive member is formed as an etched or stamped pattern in a metal plate or other thermally conductive plate such that physical barriers are formed simultaneously by the thermally conductive member according to the patterns thereon. In such case, physical barriers 216 can have either linear or free-form contours.

In yet another embodiment, a plurality of marking structures having either single or multiple ink-storing regions can be formed separately. The marking structures are then assembled together with a barrier element, e.g. closed cell foam, in a fixture and then sealed to form a marking structure having multiple ink-storing regions which are connected by a physical barrier.

In another embodiment, a plurality of porous foam members can be assembled together with a barrier element, e.g. a substantially nonporous material such as closed cell foam, in a fixture and then sealed to form a unitary member. The unitary member can then be flash printed with patterns to form a plurality of ink-storing regions in areas corresponding to the porous foam members, the regions being separated by a physical barrier.

Figure 6A:
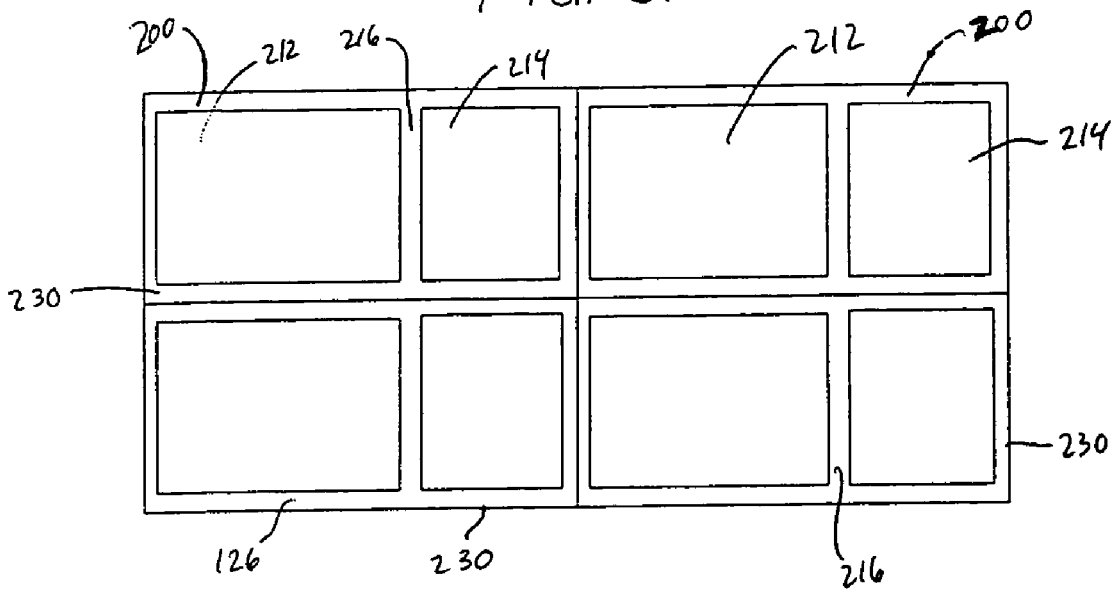
FIGS. 6A and 6B illustrate a stage in processing a foam sheet to form ink-storing regions and barriers for marking structures according to embodiments of the invention.
Figure 6B:
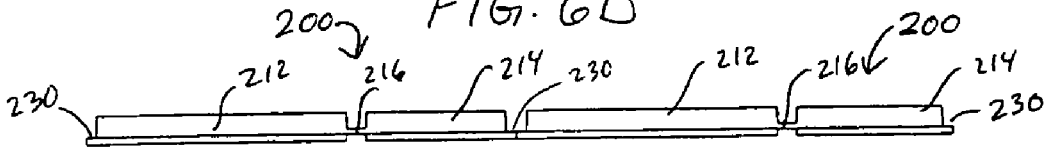

Reference is now made to FIGS. 6A and 6B, which provide a plan view and a side view of a foam sheet undergoing fabrication to form marking structures 200 in which physical barriers 216 and recessed edges 230 are provided. In this embodiment, physical barriers and recessed edges are formed prior to or concurrently with the forming of patterns on the surface of the marking structures.

In a particular example of such process, pre-mixes of liquid for forming porous foam are prepared in batches having different inks. Portions of each batch are then poured into different parts of the mold corresponding to the different ink-storing regions of the marking structure. The portions are allowed to run together at the divider areas of the mold where the physical barriers are to be formed. Alternatively, a non-ink containing batch of the liquid can be supplied to the divider areas for separating the ink-containing regions. Then, the mold is heated in a vulcanizer at a sufficient temperature and pressure for a sufficient period of time to form the microporous foam sheet having different inks impregnated in different ink-storing regions thereof, and physical barriers which separate the ink-storing regions from each other while being permanently connected to the ink-storing regions. The divider areas, being thinner than the other areas of the mold, produce a thinner material at least as dense but which may be much denser than the foam material produced as ink-storing regions of the mold. Additional heat can be locally provided to the divider areas of the mold to effect such result.

The mold can contain patterns in each part of the mold for defining the print patterns in each ink-storing region of the marking structure. The print patterns of the marking structure produced by the mold desirably are raised relative to the major surface of the marking structure. In such case, the height of the raised print patterns may be sufficient to eliminate a requirement for the surface of the marking structure to be sealed.

Figure 7:
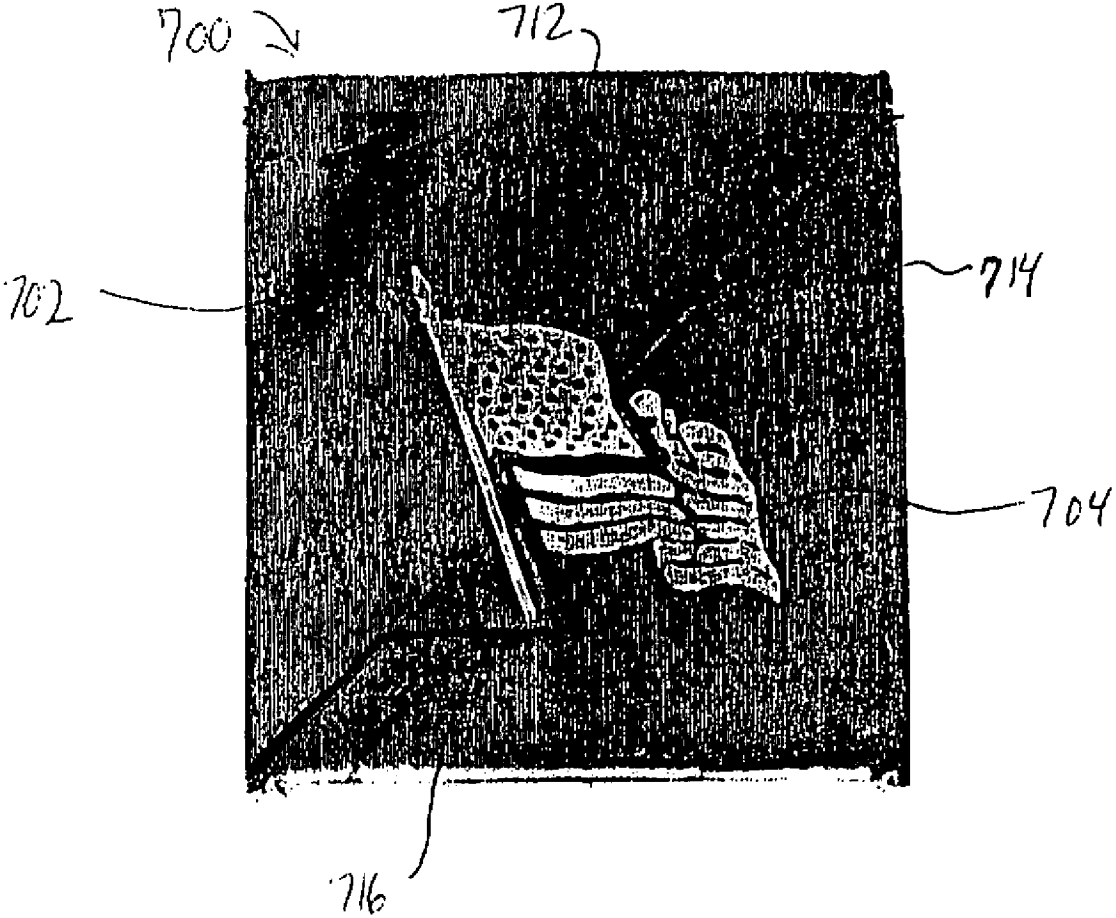
FIG. 7 illustrates a marking structure including a barrier having a free-form contour for dividing the marking structure into ink-storing regions, according to an embodiment of the invention.

In the particular embodiment shown in FIG. 7, the marking structure 700 contains different patterns 702, 704 for printing an American flag. Marking structures having similar patterns are described in commonly assigned U.S. Provisional Application No. 60/437,962 filed Jan. 3, 2003 which is hereby incorporated herein by reference. In that application, each marking structure contains only one ink and is separate from the other marking structure. The different patterns are formed on a first ink-storing region 712 and a second ink-storing region 714, respectively. The first ink-storing region 712 contains the field and staff portion 702 of the American flag while the second ink-storing region 712 contains the stripes 704 of the American flag. A physical barrier 716 having a free-form contour prevents migration of inks between the two ink-storing regions 712, 714 while permanently connecting them together in a way which avoids them from becoming separated and/or lost later in use, as well as becoming misaligned.

During manufacture of the marking structure 700 or thereafter, a first ink and a second ink can be introduced into the microporous foam body of the first and second ink-storing regions 712, 714 of the marking structure 700. When the front surfaces of the marking structure 700 is pressed against a printable surface, the ink in the ink-storing regions passes through the porous patterns 702, 704 of the front surface for printing on printable surfaces.

An embodiment of a hand stamp incorporating a marking structure will now be described, with reference to FIGS. 8-17.

Figure 9:
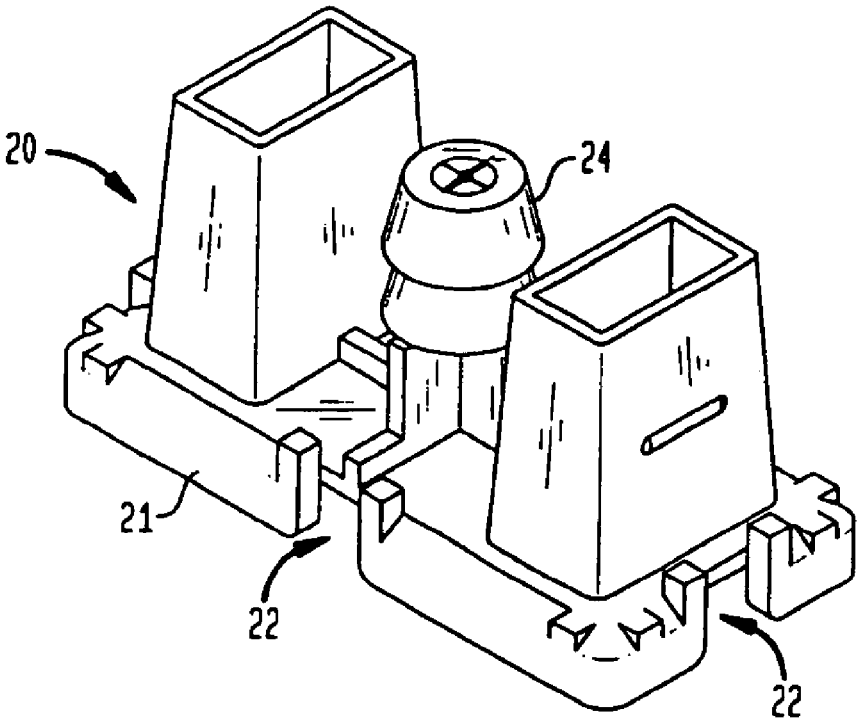
Figure 10:
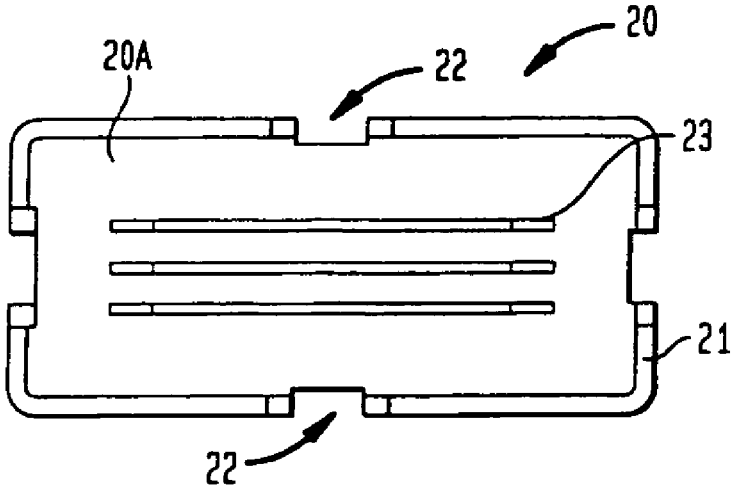
Figure 11:
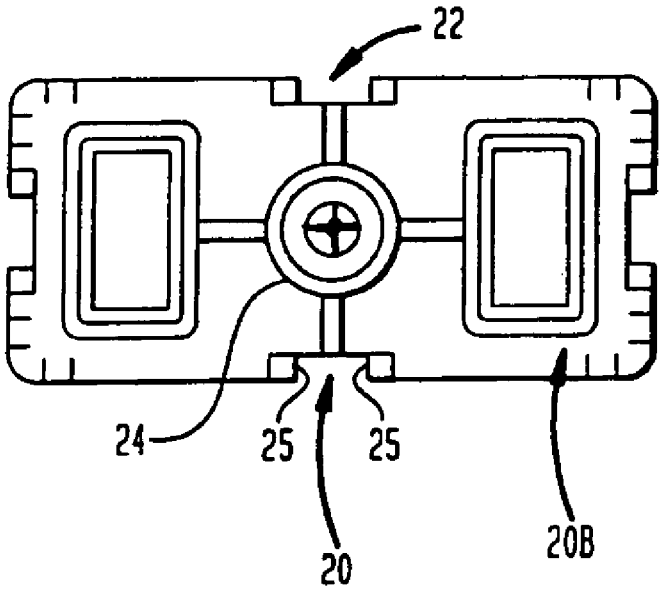

The hand stamp 10 includes five major parts: a case 11, a platen 20, a retaining member 30, a marking structure 40 and an ink supply 45. The hand stamp 10 also includes a cover 60, a spring 70, a handle 80 and a lens 90. The platen 20 is shown in FIGS. 9-11. Platen includes a substantially planar bottom or inside surface 20A and a top surface 20B. The bottom surface 20A is surrounded by a platen wall 21. The platen wall 21 has four grooves 22 extending in a direction perpendicular to the bottom surface 20A of the platen 20. Each of the grooves 22 has side walls 25. As shown in FIG. 10, the platen 20 may also include one or more openings 23 extending through both top surface 20B and bottom surface 20A of the platen 20, as well as a shaft 24, for connecting the platen 20 with the case 11. The openings 23 are designed for re-inking the ink supply 45.

Figure 12:
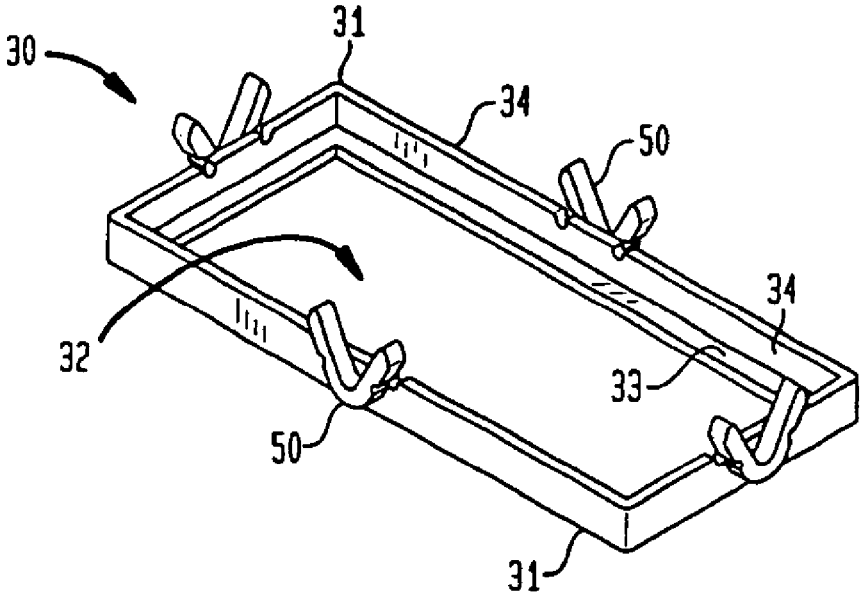
Figure 13:
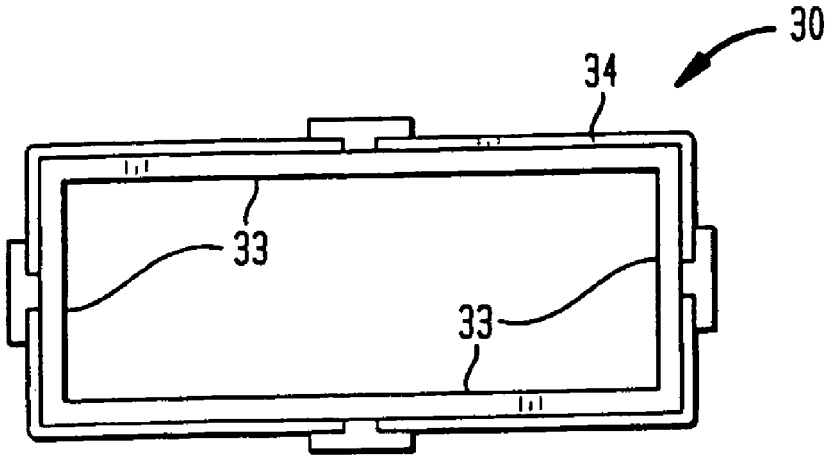

The retaining member 30 is shown in FIGS. 12-13. As can be seen from FIG. 12, the retaining member 30 includes a frame 31 defining an interior opening 32. FIG. 13 shows that the frame 31 includes a ledge 33, extending into the interior opening 32. The frame 31 also includes a sidewall 34, lying substantially perpendicular to the ledge 33. The ledge 33 secures the marking structure 40 and the ink supply 45 within the hand stamp 10. The ledge 33 extends into and narrows the interior opening 32.

Figure 14:
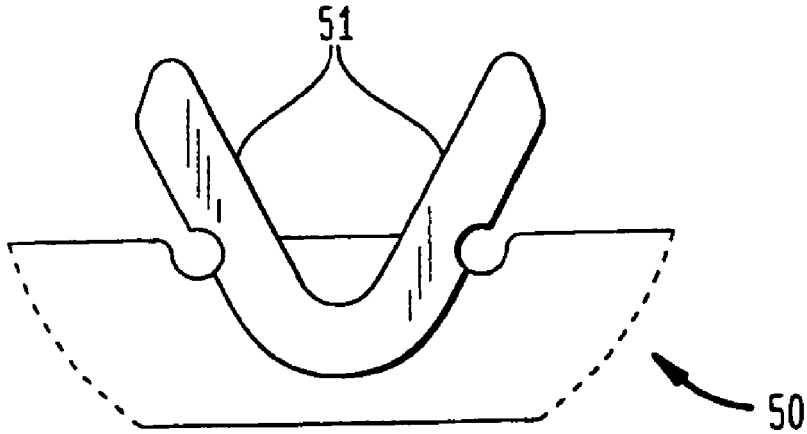

As seen in FIGS. 13-14, the retaining member 30 also includes one or more clips 50 for mounting the retaining member 30 onto the platen 20 in friction-fit arrangement. For the hand stamp 10, the clips 50 are integral with and extend from the sidewall 34 of the retaining member 30. Clips 50 are substantially perpendicular to the ledge.

In the embodiment of the invention described herein, each of the clips 50 includes two flexible and resilient fingers 51, which are capable of moving toward each other. The fingers 51 are constructed in an arrangement which has a broad part and a narrow part. In the most preferred embodiment, the arrangement has a form of the letter "V". It must be appreciated that numerous alternative designs for clips 50 are possible without deviating from the novel features of this invention, i.e., mounting the mechanical securing device onto the platen by friction.

Figure 8:
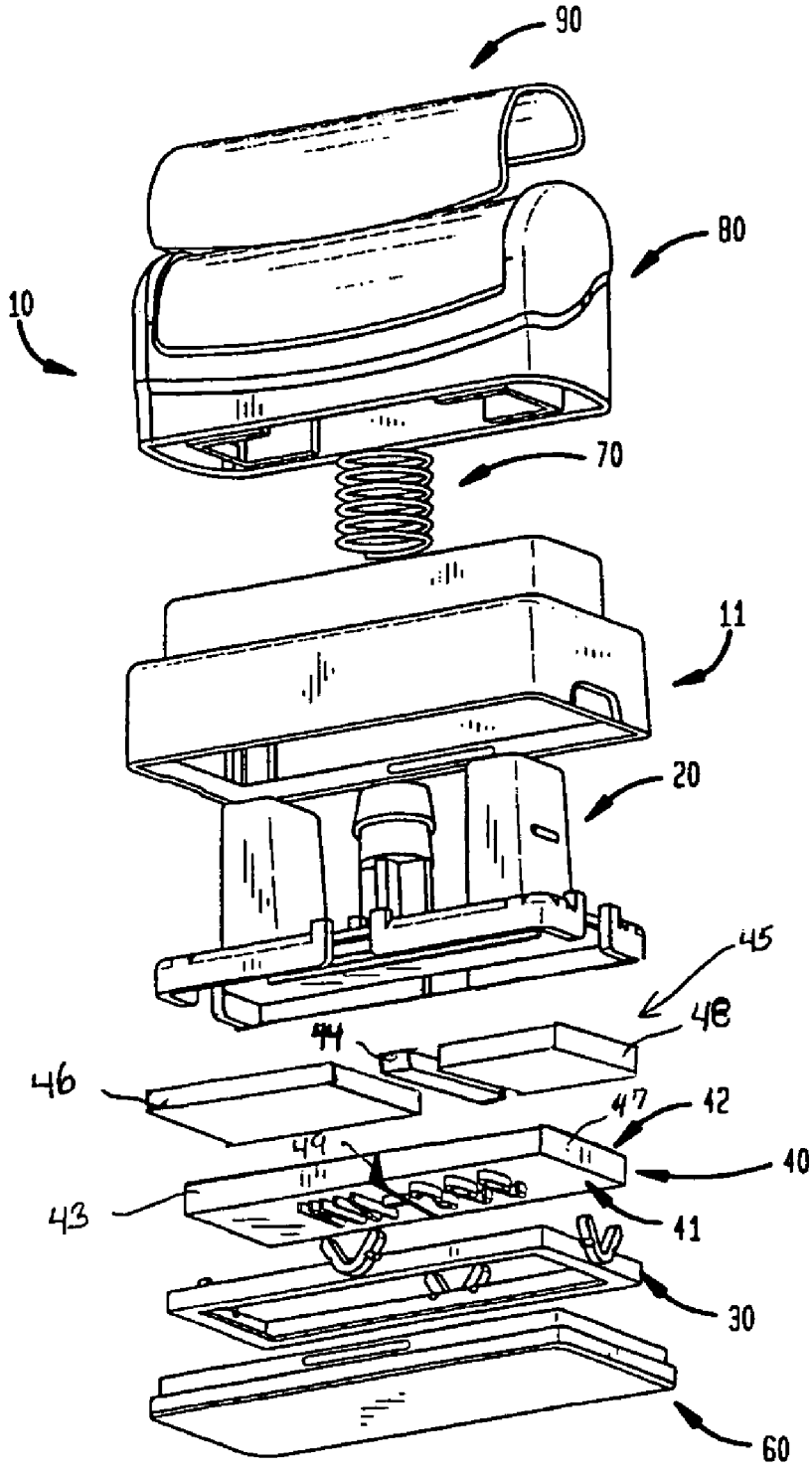
FIGS. 8-17 illustrate a handstamp and components including a marking structure and ink reservoirs thereof, according to embodiments of the invention.

Examples of marking structures are shown and described above with reference to FIGS. 1-4 and 7-8. As shown in FIG. 8, the marking structure 40 has a marking surface 41 and a non-marking surface 42. The distance between these two surfaces is the thickness of the marking structure. The marking structure 40 is divided into two ink-storing regions 43 and 47 which are connected together by a physical barrier 49 which prevents the migration of inks or other marking fluid between the two regions 43. Different marking fluids, e.g. inks of different colors, can be stored in the ink-storing regions 43, 47 of the marking structure 40.

The hand stamp includes an ink-supply 45 for storing a plurality of marking fluids, e.g. inks and supplying them to the marking structure 40. The ink supply includes first and second porous pads 46, 48 for separately storing different marking fluids or inks. Such porous pads 46, 48 can be formed of open cell foam, which can desirably be a microporous material. Between the two porous pads a separator 44 is disposed. The separator 44 desirably includes a non-porous or low-porosity material which is not permeable by the marking fluids or inks used in the porous pads. For example, the separator 44 can be formed of a closed cell foam. Closed cell foams of sufficient thickness are generally impermeable to fluids.

The different fluids or inks can be supplied to the ink supply 45 and the marking structure 40 for storage in regions 43, 47 at time of manufacture, or alternatively, at a later time upon sale to a customer or through self-assembly by the customer through openings in the platen 20, as will be further described below.

In the assembled hand stamp 10, the non-marking surface 42 of the marking structure 40 is abutted against the ink supply 45, which in turn, lies flat against the bottom surface 20A of the platen 20. The perimeter of the marking surface 41 of the marking structure 40 lies flat against and adjacent to the ledge 33. When the platen 20 is in the marking position, the patterns (e.g. raised characters) on the marking surface 41 of the marking structure 40 extend through the interior opening 32, whereas the ledge 33 covers the perimeter of the marking surface 41.

Figure 15:
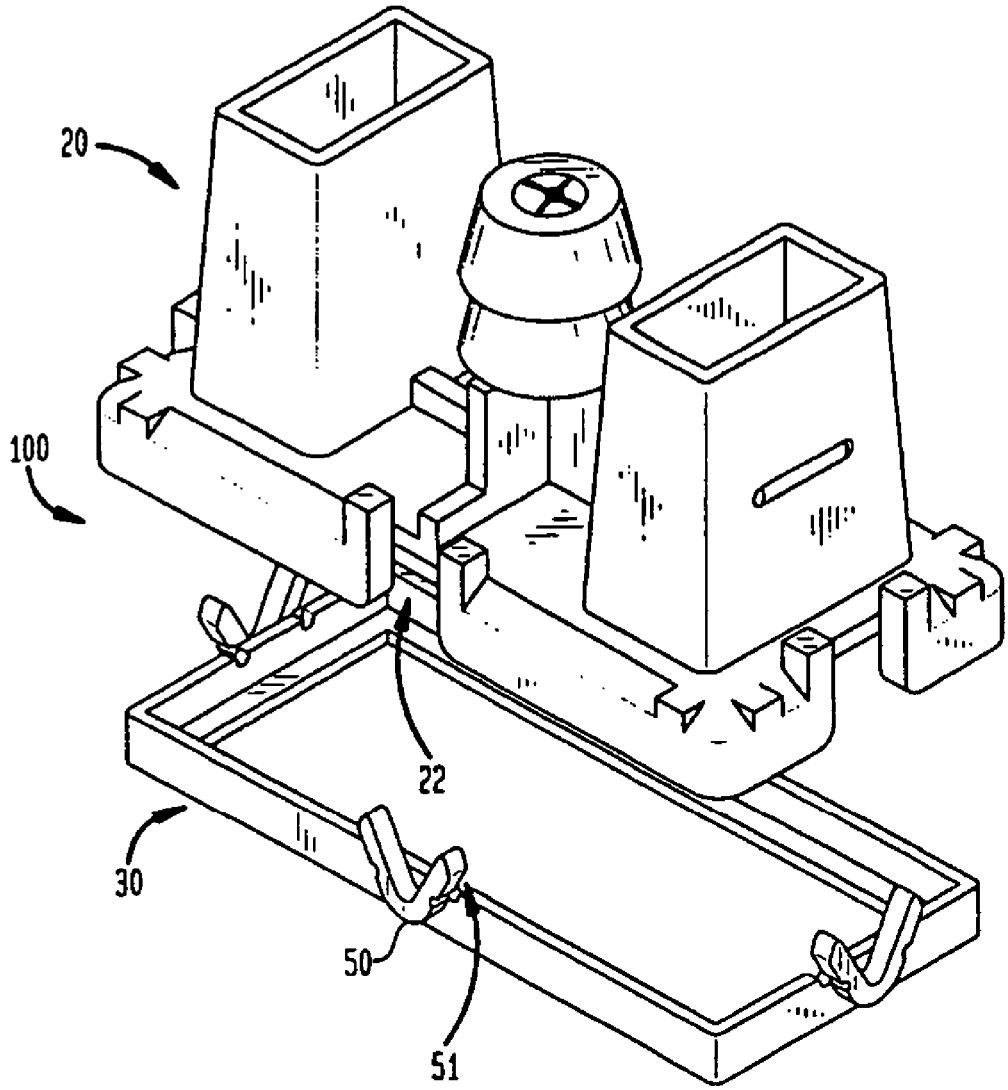

FIG. 15 illustrates the positions of the platen 20 and the retaining member 30 before the hand stamp 10 is assembled. The fingers 51 are positioned against the grooves 22 of the platen 20. The width of the grooves 22 is adopted for receiving the fingers 51 by being slightly smaller than the broad part of the arrangement of the fingers 51, as the same time allowing the fingers 51 to be inserted. When the fingers 51 are inserted into the grooves, fingers 51 flex toward each other, exerting pressure in the direction opposite to the direction of their flexing and creating friction between the fingers and the side walls 25 of the grooves 22. The fingers 51 will exert pressure on the side walls 25 of the grooves 22 regardless of the position of the retaining member 30 with respect to the bottom surface 20*a* of the platen 20. Thus, the position of the retaining member may be adjusted as a function of the thickness of the marking structure 40. For example, when the retaining member 30 is mounted in the position shown in FIG. 16, the hand stamp 10 may accommodate a thicker marking structure than in the position shown in FIG. 17.

In another aspect of the present invention, a part 100 for a hand stamp is provided that includes a platen and a retaining member mounted on the platen in any one of a variety of positions. One of the embodiments is the part shown in FIGS. 15-17 and designated by reference numeral 100. It includes the platen 20 and the retaining member 30, constructed and cooperating as described above with respect to the hand stamp 10.

Figure 16:
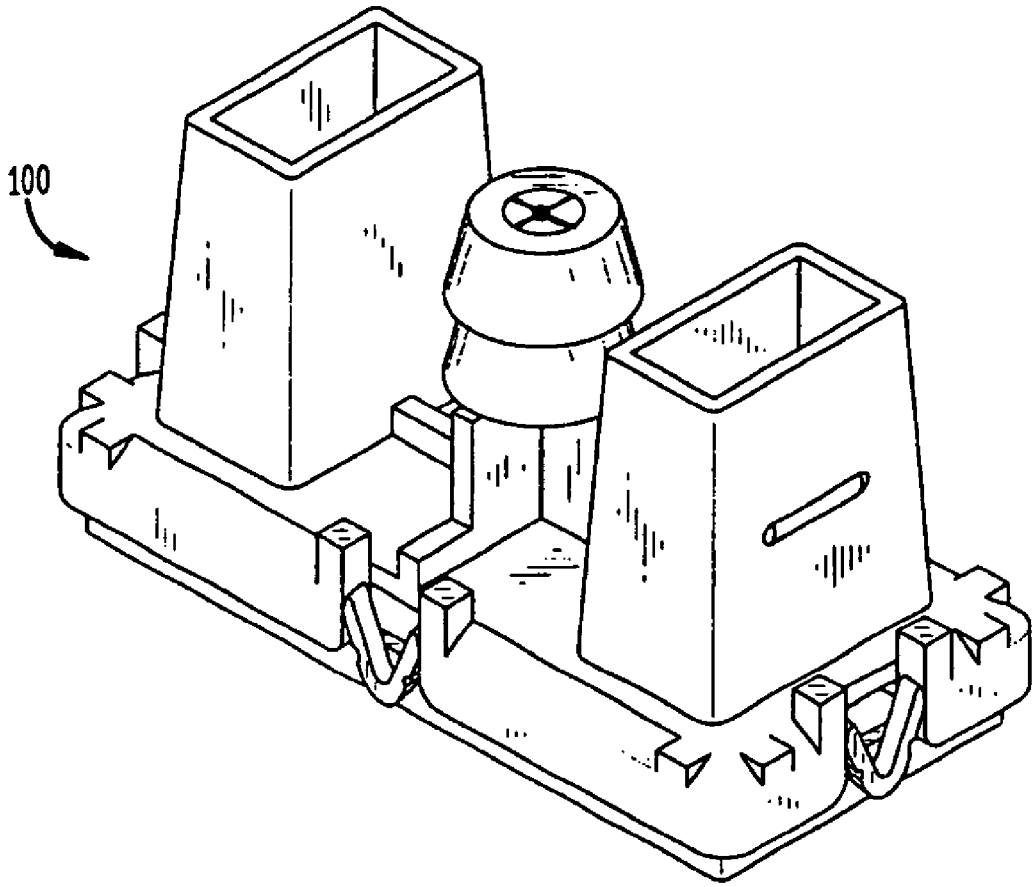
Figure 17:
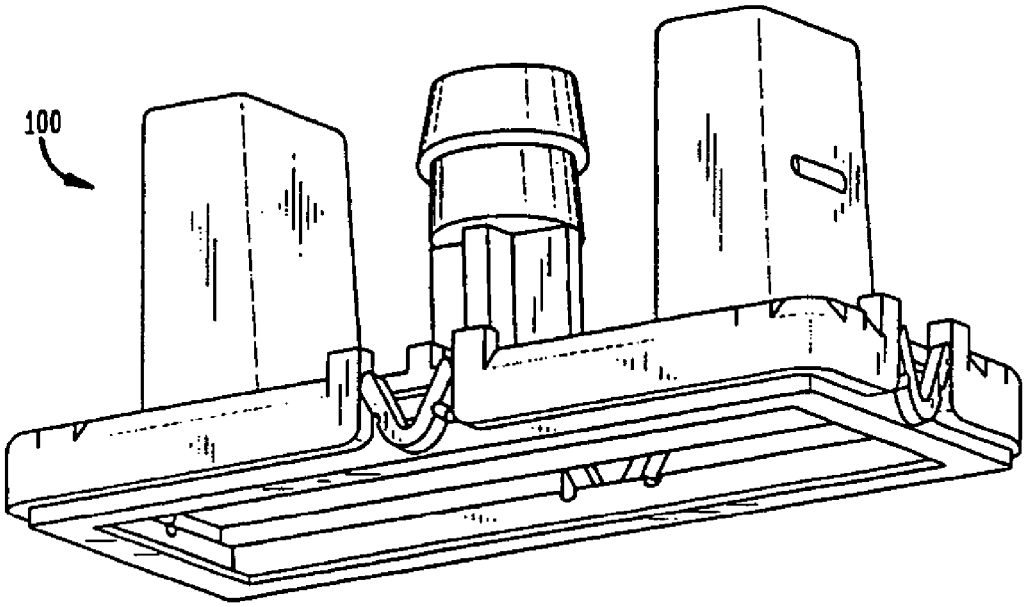

The present invention also provides a simplified method of assembly for pre-inked hand stamps. For the purpose of illustration, this method will be shown with respect to the hand stamp 10, and illustrated with reference to FIGS. 15-17. To assemble the hand stamp 10, the retaining member 30 is placed on a work surface and the marking structure 40 and ink supply 45 is inserted thereon, with the perimeter of the marking surface 41 of the marking structure 40 lying flat against and adjacent to the ledge 33 of the retaining member 30. The platen 20 is placed over the retaining member 30. In such a position, shown without a marking structure in FIG. 15, the grooves 22 of the platen 20 are opposite to the fingers 50 of the retaining member 30. Then, a force is applied to the platen 20, and fingers 51 become engaged in the grooves 22, as described above. (See FIGS. 16-17, shown without marking structure). The distance between the bottom surface 20*a* of the platen 20 and the ledge 33 of the retaining member 30 will correspond to the thickness of the particular marking structure 40 and ink supply 45 affixed thereto.

It should be understood that this method of assembly may be used with hand stamps other than the hand stamp 10, as well as that the order of steps and specific arrangements may vary. For example, the platen 20 may be placed on a work surface first.

As shown above, the use of the mechanical securing devices allows re-inking from the rear of the marking structure. Since the retaining member may be mounted onto the platen in a variety of positions, marking structures and ink supply structures of various thicknesses may be accommodated tightly between the retaining member and the platen. Thus, shims are not necessary.

The required character height on the marking surface of a marking structure is substantially less than with the prior art pre-inked hand stamps utilizing mechanical securing devices. As shown, in the existing hand stamps, a ring or ledge is mounted onto a platen by locking the mechanical securing device in place. In contrast, in the hand stamps of the present invention, the retaining member is not locked onto the platen but only secured therein. Thus, the compressibility of the retaining member is higher. For example, the flexible and resilient fingers 51 of the retaining member 30 may be flexed within the grooves 22 of the platen 20, thus allowing the hand stamp 10 to be compressed against the surface to be marked to a higher degree than the prior art hand stamps, which utilize locking of the mechanical securing device. Thus, the required character height is less.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A hand stamp, comprising:
a unitary marking structure, including:
a unitary foam member having a front surface and a rear surface, the front surface including a plurality of substantially porous portions, said unitary foam member including:
a first region adapted to store a first ink and being associated with a first part of said plurality of substantially porous portions which define at least one print pattern,
a second region adapted to store a second ink and being associated with a second part of said plurality of substantially porous portions which define at least another print pattern, and
a substantially non-porous barrier arranged between said first and second regions and between said first and second parts of said plurality of substantially porous portions to prevent said first and second inks from migrating between said first and second regions.

2. The hand stamp as claimed in claim 1, wherein said unitary foam member comprises microporous foam.

3. The hand stamp as claimed in claim 1, wherein said unitary foam member comprises a mixture of thermoplastic resin and ink.

4. The hand stamp as claimed in claim 1, wherein said first ink has a first color, and said second ink has a second color that is different than the first color.

5. The hand stamp as claimed in claim 1, wherein selected locations of said marking structure are heated by exposing said marking structure to light.

6. The hand stamp as claimed in claim 5, wherein the light is produced by laser.

7. The hand stamp as claimed in claim 1, wherein one or more non-porous portions are defined in said front surface by exposure of said marking structure to light.

8. The hand stamp as claimed in claim 7, wherein said barrier is formed simultaneously by said exposure to light.

9. The hand stamp as claimed in claim 1 wherein said marking structure is heated by contact with a thermally conductive member.

10. The hand stamp as claimed in claim 9 wherein said thermally conductive member is pressed against the foam member at said selected locations to form said barrier.

11. The hand stamp as claimed in claim 1 further comprising first and second ink reservoirs secured to said hand stamp, said ink reservoirs adapted to supply ink to said first and second regions.

12. The hand stamp as claimed in claim 11 further comprising a handle, wherein said marking structure is mounted at an opposite end of said hand stamp from said handle.

13. The hand stamp as claimed in claim 1 further comprising:
a case; and
a platen secured for selective movement within said case, wherein said marking structure is retained with said platen for movement therewith between a non-marking position where said marking structure is remote from a surface to be marked and a marking position where said marking structure is pressed into contact with the surface to be marked.

14. The hand stamp as claimed in claim 13 further comprising first and second ink reservoirs secured to said hand stamp and adapted to apply the first and second inks to said first and second regions, respectively.

15. The hand stamp as claimed in claim 14 wherein said first and second ink reservoirs comprise first and second porous pads, respectively, said porous pads being disposed between said marking structure and said platen.

16. The hand stamp as claimed in claim 15 wherein said first and second porous pads include open cell foam.

17. The hand stamp as claimed in claim 16 further comprising a blocking member disposed between said first and second porous pads, said blocking member preventing migration of ink between said first and said second porous pads.

18. The hand stamp as claimed in claim 17 wherein said blocking member includes closed cell foam.

19. The hand stamp as claimed in claim 15 further comprising:

a retaining member mountable to said platen in a plurality of positions, said retaining member adapted to secure said marking structure and said ink reservoirs to said platen in one of said plurality of positions.

20. The hand stamp as claimed in claim 17 further comprising:

a retaining member mountable to said platen in a plurality of positions, said retaining member adapted to secure said marking structure and said ink reservoirs to said platen in one of said plurality of positions.

21. The hand stamp as claimed in claim 20, wherein said plurality of positions includes an infinite number of positions between a lowermost position and an uppermost position, such that various thicknesses of said ink reservoirs and said marking structure can be secured to said platen.

22. The hand stamp as claimed in claim 21, wherein said platen includes a substantially planar bottom surface, a top surface and a perimeter; and said retaining member includes a frame defining an interior opening.

23. The hand stamp as claimed in claim 22, further comprising at least one clip constructed and arranged to secure said retaining member to said platen by friction, said at least one clip extending in a direction substantially perpendicular to said bottom surface of said platen.

24. The hand stamp as claimed in claim 23, wherein said at least one clip forms part of and is integral with said retaining member.

25. The hand stamp as claimed in claim 24, wherein said frame comprises a ledge and a sidewall integral with and substantially perpendicular to said ledge, said ledge extending into said interior opening, said ledge lying in a plane substantially parallel to said bottom surface of said platen.

26. The hand stamp as claimed in claim 25, wherein said marking surface of said stamp die has a perimeter and is arranged flat against and adjacent to said ledge.

27. The hand stamp as claimed in claim 26, wherein said at least one clip comprises a pair of flexible and resilient fingers.

28. The hand stamp as claimed in claim 27, wherein said at least one clip extends upwardly from and is integral with said sidewall of said frame of said retaining member.

29. The hand stamp as claimed in claim 28, wherein said platen comprises a platen wall, defining the perimeter of said platen, said platen wall extending in a direction substantially perpendicular to said bottom surface of said platen, said marking structure and said porous pads being enclosed by said platen wall.

30. The hand stamp as claimed in claim 29, wherein said platen wall has at least one groove having a width adopted for receiving said fingers, said groove extending in a direction substantially perpendicular to said bottom surface of said platen, said fingers engaged in said groove whereby said fingers are flexed toward each other to exert pressure in a direction opposite to the direction of their flexing, whereby said retaining member is mounted on said platen in a friction-fit arrangement.

31. The hand stamp as claimed in claim 30, further comprising a spring for biasing said platen into said non-marking position, said platen being adopted for reciprocal movement within said case.

32. The hand stamp as claimed in claim 31, wherein said at least one clip includes a pair of flexible and resilient fingers having a form of a letter "V", said fingers capable of moving toward each other such that the broad part becomes more narrow.

33. The hand stamp as claimed in claim 31, wherein said platen wall has at least one groove having a width adopted for receiving said fingers, said at least one groove extending in a direction substantially perpendicular to the bottom surface of the platen, said fingers engaged in said at least one groove thereby said fingers are flexed toward each other thereby exerting pressure in a direction opposite to the direction of their flexing, whereby said retaining member is mounted on said platen in a friction-fit arrangement.

34. The hand stamp as claimed in claim 33, wherein said retaining member comprises four clips.

35. The hand stamp as claimed in claim 34, wherein said platen, said porous pads and said retaining member are substantially rectangular.

36. The hand stamp as claimed in claim 35, wherein said retaining member is constructed of resilient and flexible material.

37. The hand stamp as claimed in claim 36, wherein said material is plastic.

38. The hand stamp as claimed in claim 13, further comprising a shaft arranged within said case and being connected between said platen and said handle.

39. The hand stamp as claimed in claim 13, further comprising a pair of openings through said platen for supplying the first and the second inks to said marking structure.

40. The hand stamp as claimed in claim 39, further comprising first and second ink reservoirs disposed in contact with said rear surface of said marking structure, wherein the first and second openings are disposed for supplying the first and second inks to said first and second ink reservoirs, respectively.

41. A marking structure for a hand stamp, said marking structure comprising:

a unitary foam member having a front surface and a rear surface, the front surface including a plurality of substantially porous portions, said unitary foam member including:

a first region adapted to store a first ink and being associated with a first part of said plurality of substantially porous portions which define at least one print pattern, a second region adapted to store a second ink and being associated with a second part of said plurality of substantially porous portions which define at least another print pattern, and a substantially non-porous barrier arranged between said first and second regions and between said first and second parts of said plurality of substantially porous portions to prevent said first and second inks from migrating between said first and second regions.

42. The marking structure as claimed in claim 41, wherein said unitary member comprises microporous foam.

43. The marking structure as claimed in claim 41 wherein said unitary member comprises a mixture of thermoplastic resin and ink.

44. The marking structure as claimed in claim 41, further comprising a first ink disposed in said first region and a second ink disposed in said second region.

45. The marking structure as claimed in claim 44 wherein said first ink has a first color and said second ink has a second color that is different than the first color.

46. The marking structure as claimed in claim 41, wherein selected locations of said unitary foam member are heated by exposing said unitary foam member to light.

47. The marking structure as claimed in claim 46, wherein the light is produced by laser.

48. The marking structure as claimed in claim 41, wherein one or more non-porous portions are defined in said front surface by exposure of said unitary member to light.

49. The marking structure as claimed in claim 48, wherein said barrier is formed simultaneously by said exposure to light.

50. The marking structure as claimed in claim 41, wherein said unitary member is heated by contact with a thermally conductive member.

51. The marking structure as claimed in claim 50 wherein said thermally conductive member is pressed against the foam member at said selected locations to form said barrier.

52. The hand stamp as claimed in claim 1, wherein said foam member is more porous in said first and second regions and less porous at said barrier.

53. The hand stamp as claimed in claim 1, wherein said first and second regions are thicker than said barrier.

54. The hand stamp as claimed in claim 41, wherein said foam member is more porous in said first and second regions and less porous at said barrier.

55. The hand stamp as claimed in claim 41, wherein said first and second regions are thicker than said barrier.

* * * * *